US012553290B2

(12) United States Patent
Grindhaug et al.

(10) Patent No.: US 12,553,290 B2
(45) Date of Patent: Feb. 17, 2026

(54) WHIPSTOCK ASSEMBLY AND ASSOCIATED METHOD OF INSTALLING THE WHIPSTOCK ASSEMBLY

(71) Applicant: Equinor Energy AS, Stavanger (NO)

(72) Inventors: Erling Grindhaug, Harstad (NO); Gaute Grindhaug, Hafrsfjord (NO); Morten Eidem, Trondheim (NO)

(73) Assignee: EQUINOR ENERGY AS, Stavanger (NO)

( * ) Notice: Subject to any disclaimer, the term of this patent is extended or adjusted under 35 U.S.C. 154(b) by 0 days.

(21) Appl. No.: 18/858,450

(22) PCT Filed: Apr. 27, 2023

(86) PCT No.: PCT/EP2023/061112

§ 371 (c)(1),
(2) Date: Oct. 21, 2024

(87) PCT Pub. No.: WO2023/209089

PCT Pub. Date: Nov. 2, 2023

(65) Prior Publication Data

US 2025/0263983 A1 Aug. 21, 2025

(30) Foreign Application Priority Data

Apr. 29, 2022 (NO) ..... 20220491

(51) Int. Cl.
*E21B 23/01* (2006.01)
*E21B 7/06* (2006.01)
*E21B 33/12* (2006.01)

(52) U.S. Cl.
CPC ..... *E21B 7/061* (2013.01); *E21B 23/01* (2013.01); *E21B 33/12* (2013.01)

(58) Field of Classification Search
CPC ..... E21B 7/061; E21B 23/01
See application file for complete search history.

(56) References Cited

U.S. PATENT DOCUMENTS 3,115,935 A * 12/1963 Hooton ..... E21B 23/0411 166/212
5,193,620 A 3/1993 Braddick
(Continued)

FOREIGN PATENT DOCUMENTS

WO 2022/081020 4/2022

OTHER PUBLICATIONS

Search Report issued Nov. 16, 2022 in corresponding Norwegian Application No. 20220491.
(Continued)

*Primary Examiner* — Cathleen R Hutchins
(74) *Attorney, Agent, or Firm* — Wenderoth, Lind & Ponack, L.L.P.

(57) ABSTRACT

A whipstock assembly including a whipstock with an inclined surface in an upper part of a housing for deflecting a drill string; an anchor, below the whipstock having run and set states, in the run state the anchor runs into the well and in the set state the anchor anchors against an inner wall of the well; a sealing device having run and set states, in the run state the sealing device runs into the well and in the set state the sealing device seals against the inner wall; an activation device for actuating the both the anchor and the sealing device from the run state to the set state and; a lock operable between: a first position in which the preventing activation of the activation device; and a second position allowing activation of the activation device thereby forcing both the anchor and the sealing device to the set state.

10 Claims, 5 Drawing Sheets

(56) References Cited

U.S. PATENT DOCUMENTS

| | | | | |
|---|---|---|---|---|
| 5,411,082 | A | 5/1995 | Kennedy | |
| 6,419,021 | B1 | 7/2002 | George et al. | |
| 10,619,438 | B2 | 4/2020 | Fripp et al. | |
| 2004/0069496 | A1* | 4/2004 | Hosie | E21B 23/0411 166/373 |
| 2015/0345241 | A1 | 12/2015 | Glaser et al. | |
| 2019/0316435 | A1 | 10/2019 | Taylor, Jr. | |

OTHER PUBLICATIONS

International Search Report and the Written Opinion of the International Searching Authority issued Jun. 30, 2023 in corresponding International Application No. PCT/EP2023/061112.

* cited by examiner

WHIPSTOCK ASSEMBLY AND ASSOCIATED METHOD OF INSTALLING THE WHIPSTOCK ASSEMBLY

The invention relates to a whipstock assembly for installation in a well, as well as a method of installing the whipstock assembly in the well. The whipstock assembly comprises a whipstock device with an inclined surface, an anchoring device below the whipstock device and a sealing device below the whipstock device.

BACKGROUND OF THE INVENTION

Drilling of hydrocarbon wells, i.e. oil and gas wells, includes drilling a hole in the earth. In order to prevent cave in, the hole is normally lined with steel pipe (known as casing) that is cemented into place to isolate specific parts the wellbore for the collection of hydrocarbons. Once the casing is cemented into place, the hydrocarbons can be gathered using a smaller string of tubulars named production tubing. For various reasons, including reduced production from the areas close to the well or stuck pipes or tools which block the well preventing further drilling or use of the well, it may be desirable to drill another well or so-called "branch" as a sidetrack starting from the existing drilled well. In order to be able to drill this new, lateral branch, it is required to use a so-called whipstock which is installed in the existing well at the location you want to drill the new, lateral branch.

A whipstock is a downhole tool with a wedge shape which is put into the borehole to start off the drilling of the new lateral branch. The whipstock or whipstock assembly typically also has a slips segment for anchoring the whipstock assembly to the wall of the well. Whipstocks normally have a wedge shaped part which is typically oriented between +/−60 degrees. 45 degrees may be preferred, but it will depend on well path to be drilled. When the whipstock assembly has been installed in the well, the drill bit of the drill string comes into contact with the wedge surface and is forced laterally towards the casing wall and drills a hole in the casing and further into the formation outside the existing well.

Whipstock assemblies are normally installed or run using a drill string. When running whipstock it is at times needed to isolate the wellbore below by use of a packer element. The whipstock assembly may thus also include a packer element which seals against the inner wall of the casing. Current systems use a hydraulic line from the drill string to the packer and slips segment and these lines fails at times, making it impossible to set the whipstock or activate the packer.

An objective of the invention is to provide a solution to install a whipstock which is more reliable and less subject to failure compared to the prior art solutions.

SUMMARY OF THE INVENTION

The present invention is set forth and characterized in the independent claims, while the dependent claims describe other characteristics of the invention.

It is described a whipstock assembly for installation in a well, the whipstock assembly comprising a housing extending in a longitudinal direction, wherein the whipstock assembly comprises:

- a whipstock device with an inclined surface located in an upper part of the housing for deflecting a drill string;

- an anchoring device below the whipstock device, the anchoring device having a run state and a set state, and wherein in the run state the anchoring device is configured to be run into the well and in the set state the anchoring device is configured to anchor against an inner wall of the well;
- a sealing device below the whipstock device, the sealing device having a run state and a set state, and wherein in the run state the sealing device is configured to be run into the well and in the set state the sealing device is configured to seal against the inner wall of the well;
- an activation device for actuating the anchoring device from the run state to the set state and for actuating the sealing device from the run state to the set state;
- a locking device operable between:
  - a first position in which the locking device prevents activation of the activation device; and
  - a second position in which the locking device allows activation of the activation device thereby forcing the anchoring device to the set state and the sealing device to the set state.

In a run state of the whipstock assembly, the anchoring device and the sealing device are in passive or retracted positions allowing the whipstock assembly to be moved in the well.

In a set state of the whipstock assembly, the anchoring device and the sealing device are in active or extended positions in contact with the inner wall of the well preventing or reducing the possibility of moving the whipstock assembly in the well.

In the run state of the anchoring device, the anchoring device is retracted and not in contact with the inner wall of the well. In the run state, the anchoring device may be within a circumferential envelope of the housing.

In the set state of the anchoring device, the anchoring device is in contact with the inner wall of the well preventing movement of the housing in the longitudinal direction. In the set state, the anchoring device may extend outside the circumferential envelope of the housing.

In the run state of the sealing device, the sealing device allows fluid communication between a first position above the sealing device and a second position below the sealing device. In the run state, the sealing device may be within the circumferential envelope of the housing.

In the set state of the sealing device, the sealing device seals against the inner wall of the well and prevents fluid communication between the first position and the second position. The inner wall of the well will normally be the inner wall of the casing. In the set state, the sealing device may extend outside the circumferential envelope of the housing.

The sealing device may be arranged below the anchoring device, or vice versa.

The sealing device may be a compressible packer. However, other sealing devices providing the desired and required function of sealing against the inner wall of a well may also be used.

The whipstock assembly may comprise a stopper element on an opposite side of the sealing device compared to the activation device. The stopper element may be configured to prevent axial movement of the sealing device in the well. I.e., the stopper element may force the sealing device to compress in a radial direction.

The activation device may comprise at least one pretensioned spring.

Using a spring activation to set both the anchoring device and the sealing device simultaneously reduces time needed to perform the operation and reduces risk of failure. In addition to the dedicated anchoring device, the sealing device may also include an anchoring element, such as e.g. a slips segment, which further expand when applying weight from surface. This will anchor the whipstock assembly even more to the inner wall of the well.

The activation device may comprise a first piston element in contact with the anchoring device and a second piston element in contact with the sealing device, and the at least one pre-tensioned spring may be configured to exert a force on the first piston element to force the anchoring device into the set state and on the second piston element to force the sealing device into the set state.

The activation device may comprise a guiding means for guiding movement of the at least one pre-tensioned spring in a desired direction upon activation of the anchoring device to the set state and the sealing device to the set state.

The guiding means may be a first rod connected to the first piston element and which extends to a connection element for the at least one pre-tensioned spring and a second rod connected to the second piston element and which extends to the connection element of the at least one pre-tensioned spring to ensure that the spring force is directed in the desired direction. The connection element is preferably fixed to the housing to ensure that the first pre-tensioned spring and the second pre-tensioned spring exert their respective forces against the respective first piston element and second piston element. In other words, the connection element may be configured to withstand the forces from the first pre-tensioned spring and the second pre-tensioned spring.

Alternatively, the guiding means may be a hollow bore extending from the anchoring point for the at least one pre-tensioned spring to the respective first piston element and second piston element and the at least one pre-tensioned spring may be guided within the bore upon expansion.

The activation device may comprise a first pre-tensioned spring for activating the anchoring device and a second pre-tensioned spring for activating the sealing device, and the locking device may prevent expansion of the first pre-tensioned spring and the second pre-tensioned spring in the first position and allow expansion of the first pre-tensioned spring and the second pre-tensioned spring in the second position.

The first pre-tensioned spring and second pre-tensioned spring may be arranged between the anchoring device and the sealing device, and the first pre-tensioned spring may be configured to exert an upward force on the anchoring device to the set state of the anchoring device and the second pre-tensioned spring may be configured to exert a downward force on the sealing device to the set state of the scaling device.

The activation device may comprise one mutual pre-tensioned spring for activating both the anchoring device and the sealing device, and the locking device may prevent expansion of the mutual pre-tensioned spring in the first position and allow expansion of the mutual pre-tensioned spring in the second position.

The mutual pre-tensioned spring may be arranged between the anchoring device and the sealing device, and one end of the mutual pre-tensioned spring may be configured to exert a force on the first piston element and a second end of the pre-tensioned spring may be configured to exert a force on the second piston element.

The activation device may comprise a distance element providing a fixed distance between the first piston element and the second piston element, and the second piston element may be arranged below the sealing device, and the mutual pre-tensioned spring may be arranged below the sealing device.

Thus, according to this aspect, the mutual pre-tensioned spring, i.e. a common pre-tensioned spring, activates both the anchoring device to the set state and the sealing device to the set state.

The distance element provides a fixed distance between the first piston element and the second piston element such that the anchoring device and the sealing device are activated upon releasing the mutual pre-tensioned spring. The distance element preferably extends from a position below the sealing device, upwardly through a center of the sealing device and to the anchoring device. The distance element may be a rod and the first piston element and the second piston element may be fixedly connected to opposite end regions of the rod. In one aspect, the first piston element 10 may be connected at an upper end of the rod and the second piston element may be connected in a lower end of the rod.

The housing may comprise:

- an internal chamber for accommodating the locking device;
- a fluid connection port, which fluid connection port may extend between an outside of the housing and to the internal chamber;
- and the locking device may be radially movable from the first position to the second position within the internal chamber upon exertion of a fluid pressure from an outside of the housing through the fluid connection port and into the internal chamber.

Alternatively, or additionally, moving or activating the locking device from the first position to the second position may be performed using other activation mechanisms such as a chamber with a break disc that collapse over a predetermined differential pressure, or alternatively an electric system allowing a chamber to collapse when receiving and input signal.

The anchoring device may comprise a slips segment.

It is further described a method of installing the whipstock assembly as defined above, wherein the method comprises the steps of:

- connecting the whipstock assembly to a drill string;
- ensuring that the locking device is in the first position in which it prevents activation of the activation device;
- running the drill string and the connected whipstock assembly to a position in the well where a branch is to be drilled;
- disconnecting the whipstock assembly from the drill string;
- applying a pressure in the well at the position of the whipstock assembly thereby activating the locking device to the second position in which it allows activation of the activation device thereby forcing the anchoring device to the set state and the sealing device to the set state.

In an aspect of the method, the housing may comprise an internal chamber for accommodating the locking device and a fluid connection port, and the fluid connection port may extend between an outside of the housing and to the internal chamber; and the step of applying a pressure in the well may increase the pressure in the internal chamber thereby moving the locking device in a radial direction to the second position.

The relative terms “upper”, “lower”, “top”, “bottom”, “below”, “above”, “higher” etc. shall be understood in their normal sense and as seen in a cartesian coordinate system. In particular, in relation to a well, “upper”, “above”, "higher" and "top" is to be understood as closer to the surface of the well compared to "lower", "bottom" and "below".

BRIEF DESCRIPTION OF THE DRAWINGS

The following drawings are appended to facilitate the understanding of the invention. The drawings show embodiments of the invention, which will now be described by way of example only, where:

FIG. 1A shows the whipstock assembly in a run state being installed in the well using a drill string, where a locking device of the whipstock assembly is in a first position preventing the anchoring device and the sealing device from moving from their respective run states to set states;

FIG. 1B shows the situation when the locking device is activated to a second position where the first pre-tensioned spring and the second pre-tensioned spring are about to be expanded forcing the anchoring device and the sealing device from their run states to their set states; and FIG. 1C shows the situation when the anchoring device and the sealing device have entered their respective set states;

FIG. 2A shows the whipstock assembly in a run state being installed in the well using a drill string, where a locking device of the whipstock assembly is in a first position preventing an anchoring device and a sealing device of the whipstock assembly from moving from their respective run states to set states;

FIG. 2B shows the situation when the anchoring device and the sealing device have entered their respective set states;

DETAILED DESCRIPTION OF THE INVENTION

Figure 1A:
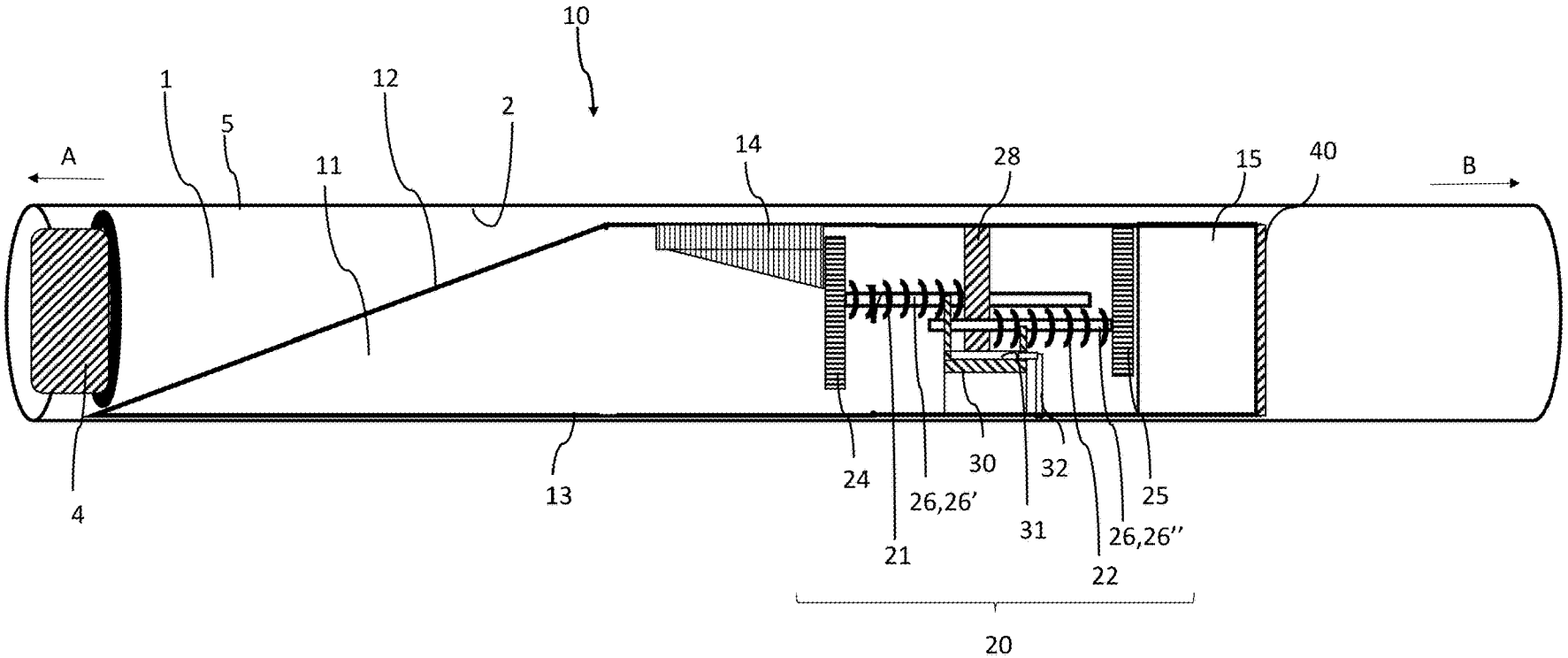
FIGS. 1A-1C show time-lapse of relative positions of a whipstock assembly according to a first embodiment of the invention where an activation device of the whipstock assembly comprises a first pre-tensioned spring and a second pre-tensioned spring arranged between an anchoring device and a sealing device of the whipstock assembly, where.

In the following, embodiments of the invention will be discussed in more detail with reference to the appended drawings. It should be understood, however, that the drawings are not intended to limit the invention to the subject-matter depicted in the drawings.

First Embodiment of the Whipstock Assembly According to the Invention

Figure 1B:
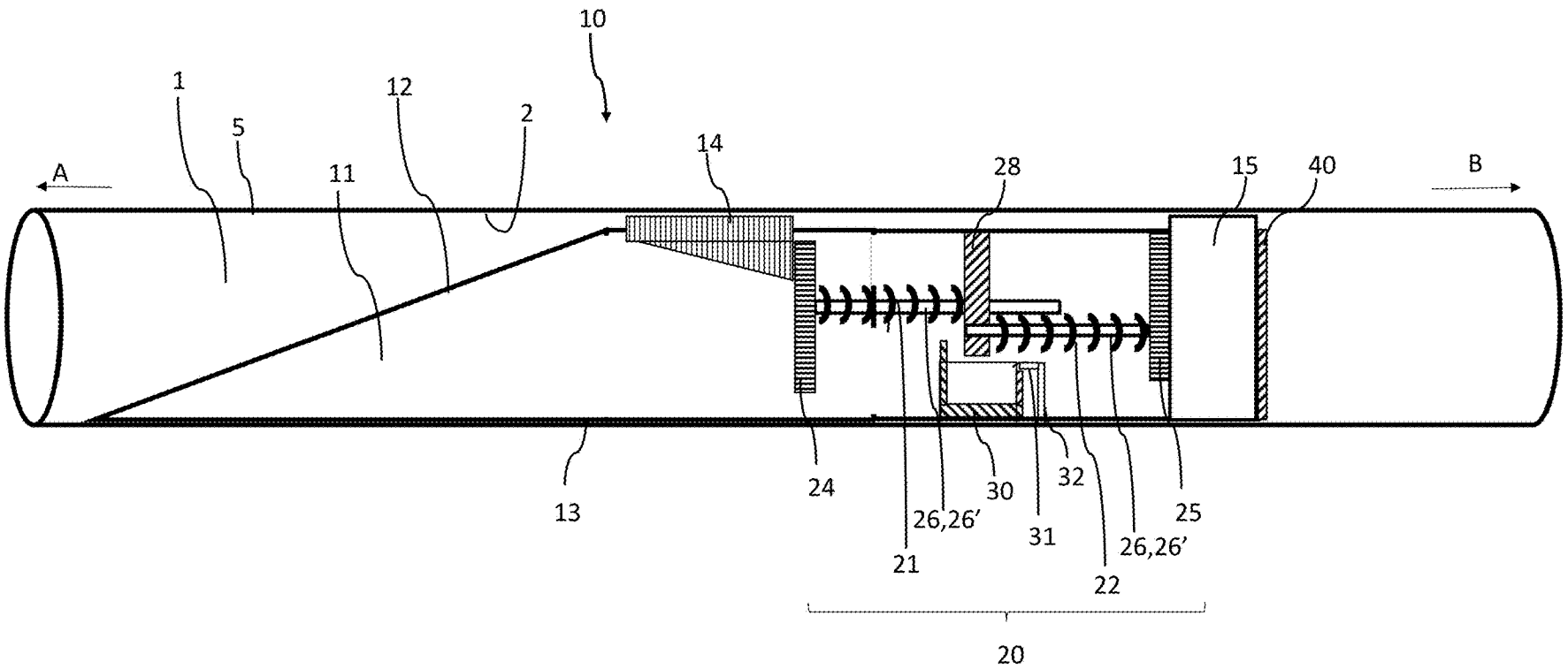
Figures 1C, 1D:
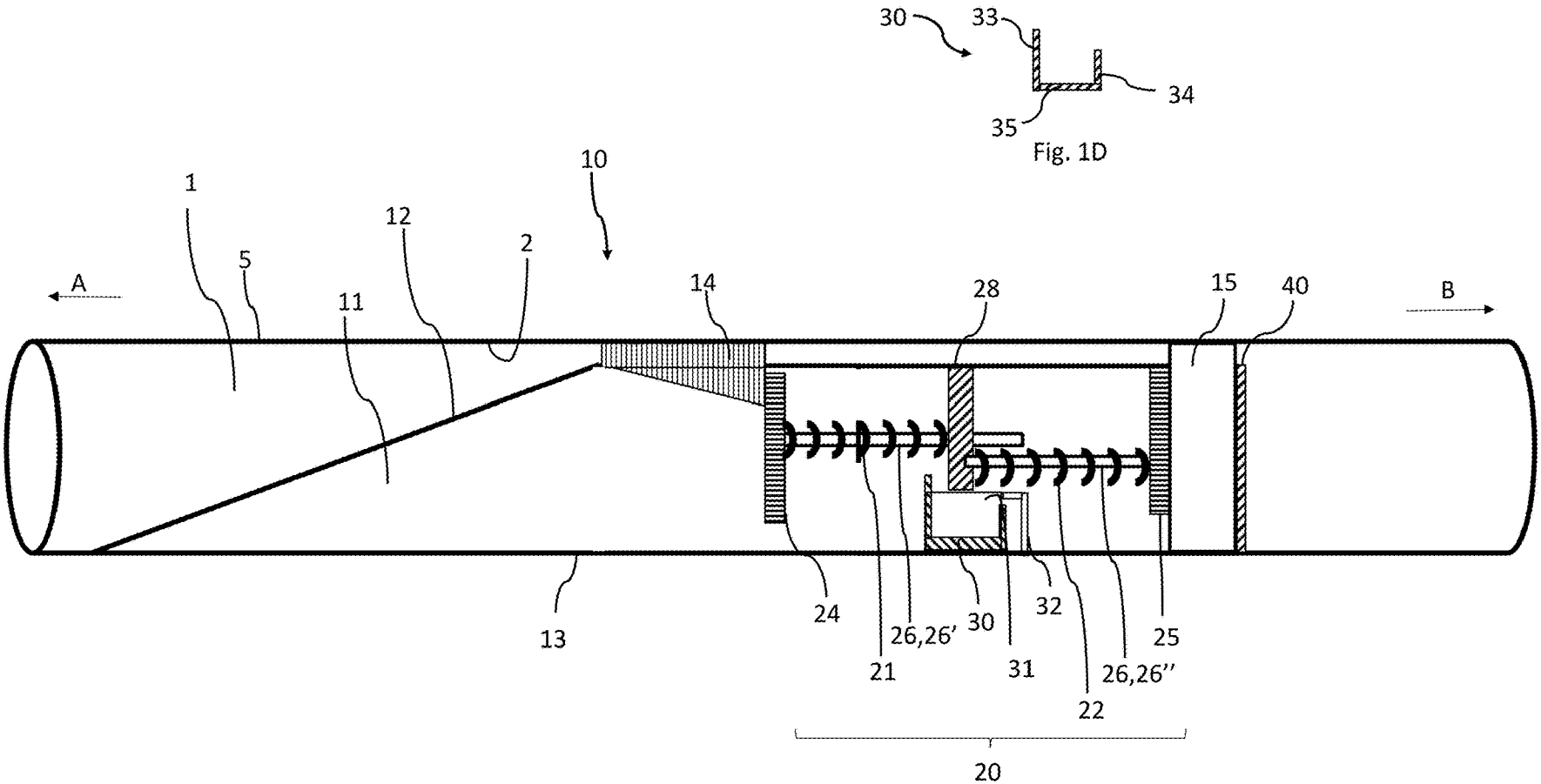
FIG. 1D shows details of the locking device in the embodiment of the whipstock assembly in FIGS. 1A-1C.

FIGS. 1A-1C show time-lapse of relative positions of a whipstock assembly 10 according to a first embodiment of the invention where an activation device 20 of the whipstock assembly 10 comprises a first pre-tensioned spring 21 and a second pre-tensioned spring 22 arranged between an anchoring device 14 and a scaling device 15 of the whipstock assembly 10. It shall be noted that although an embodiment using two pre-tensioned springs is shown in FIGS. 1A-1C, it may also be possible to use one pre-tensioned spring between the anchoring device 14 and the sealing device 15, and configure the locking device to close on both sides of the one pre-tensioned spring. The one pre-tensioned spring may then activate both the anchoring device 14 and the sealing device 15 when the spring is expanded.

Referring to FIGS. 1A-1C a well 1 cased with a casing 5 is shown. The casing 5 separates the well 1 from the surrounding formation. The well 1, i.e. the casing 5, has an inner wall 2. Arrow A indicates the direction towards the top of the well 1, i.e. towards surface, whereas Arrow B indicates the direction towards the bottom of the well 1, i.e. direction away from surface of the well 1.

The whipstock assembly 10 comprises a housing 13 extending along a longitudinal direction of the well 1. In an upper part of the housing 13 it is disclosed a whipstock device 11 with an inclined surface 12 for deflecting a drill bit of a drill string 4. The whipstock device 11 functions as a sliding ramp and has an inclined surface 12 for directing the drill string towards the wall 2 of the well to drill a window (not shown) in the casing 5 and further continue drilling into the surrounding formation.

The form, shape, function and construction of the whipstock device 11 is known to the person skilled in the art and will not be discussed in greater detail herein.

Below the whipstock device 11 of the whipstock assembly 10, the anchoring device 14 in the form of a slips segment is disclosed. The anchoring device 14 has a run state and a set state. In the run state, the anchoring device 14 is configured to be run into the well 1, and in the set state the anchoring device 14 is configured to anchor against the inner wall 2 of the well 1 or casing 5.

The sealing device 15 is arranged below the anchoring device 14. The sealing device 15 has a run state and a set state. In the run state, the sealing device 15 is configured to be run into the well 1, and in the set state the sealing device 15 is configured to seal against the inner wall 2 of the well 1.

The activation device 20 for actuating the anchoring device 14 from the run state to the set state and for actuating the sealing device 15 from the run state to the set state, is arranged between the anchoring device 14 and the sealing device 15.

The activation device 20 comprises a locking device 30 which is operable between a first position in which the locking device 30 prevents activation of the activation device 20, and a second position in which the locking device 30 allows activation of the activation device 20 thereby forcing the anchoring device 14 to the set state and the sealing device 15 to the set state.

In a lowermost part of the whipstock assembly 10, a stopper element 40 is disclosed. The stopper element 40 is thus arranged on an opposite side of the sealing device 15 relative to the activation device 20. The stopper element 40 is configured to prevent axial movement of the sealing device 15 in the well 1 such that it compresses in the radial direction. The axial extension of the housing 13 is constant, thus the distance between the stopper element 40 and the whipstock device 11 is constant.

The activation device 20 is further disclosed comprising a first piston element 24 in contact with the anchoring device 14 and a second piston element 25 in contact with the sealing device 15.

The activation device 20 is further disclosed comprising a first pre-tensioned spring 21 for activating the anchoring device 14 and a second pre-tensioned spring 22 for activating the sealing device 15. The first pre-tensioned spring 21 and the second pre-tensioned spring 22 are arranged between the anchoring device 14 and the sealing device 15. The first pre-tensioned spring 21 is configured to exert an upward force on the anchoring device 14 to the set state of the anchoring device 14 (as shown in FIG. 1C) and the second pre-tensioned spring 22 is configured to exert a downward force on the sealing device 15 to the set state of the sealing device 15 (as shown in FIG. 1C).

The locking device 30 prevents expansion of the first pre-tensioned spring 21 and the second pre-tensioned spring 22 in the first position (as shown in FIG. 1A) and allows expansion of the first pre-tensioned spring 21 and the second pre-tensioned spring 22 in the second position (as shown in FIG. 1C).

The activation device 20 further comprises a connection element 28 arranged between the first piston element 24 and the second piston element 25. The connection element 28 is fixed to the housing 13 and provides an end point for the first pre-tensioned spring 21 and the second pre-tensioned spring 22. The connection element 28 ensures that the first pre-tensioned spring 21 and the second pre-tensioned spring 22 exerts the stored force against the respective first piston element 24 and second piston element 25. In other words, the connection element 28 is configured to withstand the forces from the first pre-tensioned spring 21 and the second pre-tensioned spring 22.

The activation device 20 is further disclosed comprising a guiding means 26 for guiding movement of the first pre-tensioned spring 21 and the second pre-tensioned spring 22 in a desired direction upon activation of the anchoring device 14 to the set state and the sealing device 15 to the set state. In FIGS. 1A-IC, the guiding means 26 is in the form of a first rod 26' connected to the first piston element 24 and extending to the connection element 28 and a second rod 26" connected to the second piston element 25 and extending to the connection element 28 to ensure that the spring force is directed in the desired direction.

The housing 13 is disclosed with an internal chamber 31 for accommodating the locking device 30, and a fluid connection port 32 extending between an outside of the housing 13 and to the internal chamber 31. The locking device 30 is radially movable from the first position to the second position within the internal chamber 31 upon exertion of a fluid pressure from an outside of the housing 13 through the fluid connection port 32 and into the internal chamber 31 on a radial inside of the locking device 3.

Although an embodiment of an activation device 20 using internal chamber 31 and fluid connection port 32 is disclosed, other activation mechanisms such as a chamber with a break disc that collapse over a pre-determined differential pressure, alternatively an electric system allowing a chamber to collapse when receiving and input signal (such as pressure pulse).

As shown in FIGS. 1A and 1D, the locking device 30 is formed by a first member 33 and a second member 34. The first and second members 33, 34 are parallel and connected to each other via a cross link 35. The first member 33, the cross link 35 and the second member 34 form a U-shape. The first member 33 is somewhat longer than the second member 34. This is due to that the distance from the cross link 35 to the first rod 26' is longer than the distance from cross link 35 to the second rod 26".

When the locking device 30 is in the first position, the first member 33 mechanically prevents expansion of the first pre-tensioned spring 21 by blocking the first pre-tensioned spring 21. Similarly, the second member 34 mechanically prevents expansion of the second pre-tensioned spring 22 by blocking the second pre-tensioned spring 22. When the locking device 30 is forced radially outwards, the first and second members 33, 34 do not block the first and second pre-tensioned spring 21, 22 from expansion anymore, thus the first and second pre-tensioned springs 21, 22 are allowed to expand and activate both the anchoring device 14 and the sealing device 15 to their set states.

Referring to FIGS. 1A-IC, an example of activating the anchoring device 14 and the sealing device 15 will be explained.

As discussed above, FIG. 1A shows the whipstock assembly 10 in a run state being installed in the well using a drill string 4. The desired position in the well 1 has been reached and the whipstock assembly 10 can be disconnected from the drill string 4. In the run state of the whipstock assembly 10, all components of the whipstock assembly 10 are typically in a retracted or passive position within a circumferential envelope of the whipstock housing 13. As seen in FIG. 1A, the locking device 30 of the whipstock assembly 10 is in the first position and the anchoring device 14 and the sealing device 15 of the whipstock assembly 10 are in their run states prevented from being activated to their respective set states by the locking device 30. FIG. 1A thus illustrate a run state of the whipstock assembly 10.

FIG. 1B shows the situation when the locking device 30 is activated to a second position where the first pre-tensioned spring 21 and the second pre-tensioned spring 22 are about to be expanded forcing the anchoring device 14 and the sealing device from their run states to their set states. This can be seen when comparing the relative position of the first piston element 24, the anchoring device 14, the second piston element 24 and the sealing device 15 in FIGS. 1A and 1B. Starting with the relative position of the first piston element 24 and the second piston element 25 it can be seen that both the first piston element 24 and the second piston element 25 are further away from the connection element 28 in FIG. 1B than in FIG. 1A. Similarly, the anchoring device 14 in FIG. 1B has been moved radially outwards compared to the anchoring device 14 in FIG. 1A and the sealing device 15 has been compressed and a smaller gap is formed between the sealing device 15 and the inner wall 2 of the well 1 in FIG. 1B than in FIG. 1A. Due to the fact that the distance between the whipstock device 11 and stopper element 40 is constant, the sealing device 15 is compressed against the stopper element 40 when a force is exerted from the second pre-tensioned spring 22 to the second piston element 25 and on to the sealing device 15.

Activation of the activation device 20 for actuating the anchoring device 14 from the run state (in FIG. 1A) towards the set state and for actuating the sealing device from the run state (FIG. 1A) towards the set state may be performed by applying a pressure in the well 1 at the position of the whipstock assembly 10. This applied pressure enters the fluid connection port 32 and the internal chamber 31, pushing the locking device 30 radially outwardly thereby activating the locking device 30 to the second position in which it allows activation of the activation device 20 forcing the anchoring device 14 towards the set state and the sealing device 15 towards the set state.

FIG. 1C shows the situation when the anchoring device 14 and the sealing device 15 have entered their respective set states Compared to FIG. 1B, the relative position of the first piston element 24, the anchoring device 14, the second piston element 24 and the sealing device 15 in FIGS. 1B and 1C have changed. Starting with the relative position of the first piston element 24 and the second piston element 25, both the first piston element 24 and the second piston element 25 are further away from the connection element 28 in FIG. 1C compared to FIG. 1B. Similarly, the anchoring device 14 in FIG. 1C has moved radially outwards into contact with the inner wall 2 of the well 1. The sealing device 15 in FIG. 1C has been compressed even further into sealing contact with the inner wall 2 of the well 1. Thus, no gap is formed between the sealing device 15 and the inner wall 2 of the well 1 in FIG. 1C. FIG. 1C thus illustrates a set state of the whipstock assembly 10 where it is secured to the inner wall 2 of the well 1 and isolates the volume above the whipstock assembly 10 from the volume below the whipstock assembly 10.

Second Embodiment of the Whipstock Assembly According to the Invention

Figure 2A:
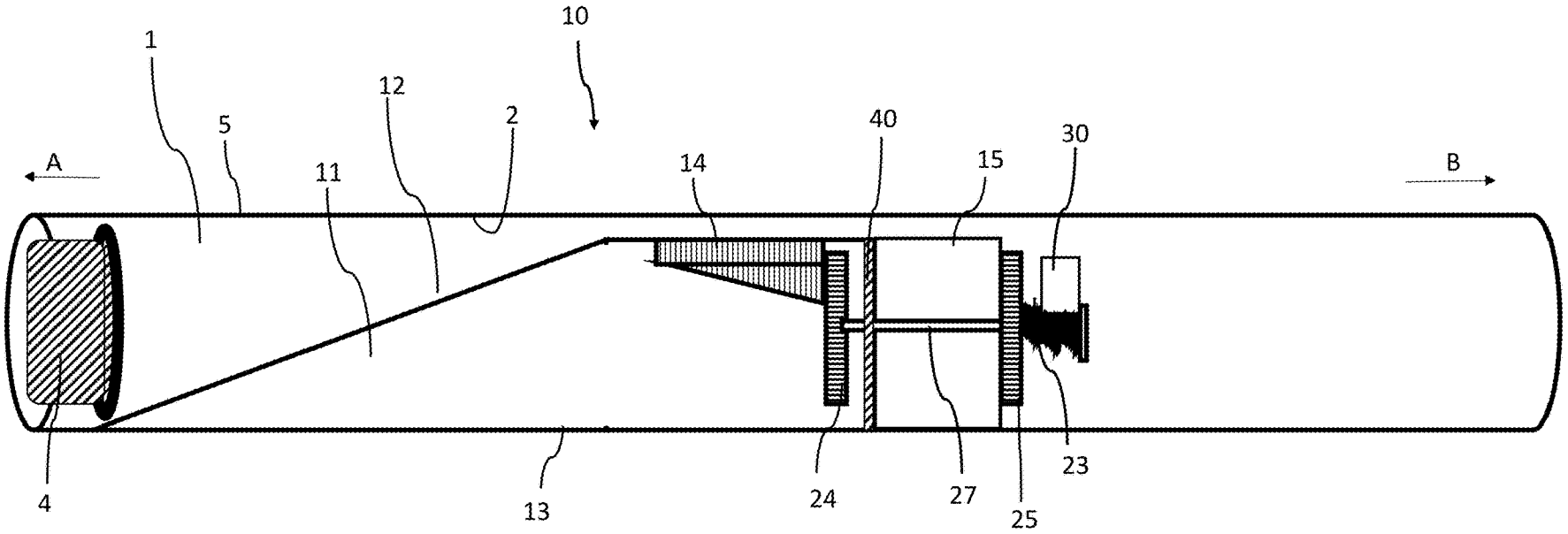
FIGS. 2A-2B shows time-lapse of relative positions of a whipstock assembly according to a second embodiment of the invention where an activation device of the whipstock assembly comprises one mutual pre-tensioned spring arranged below both an anchoring device and a sealing device of the whipstock assembly, where.
Figure 2B:
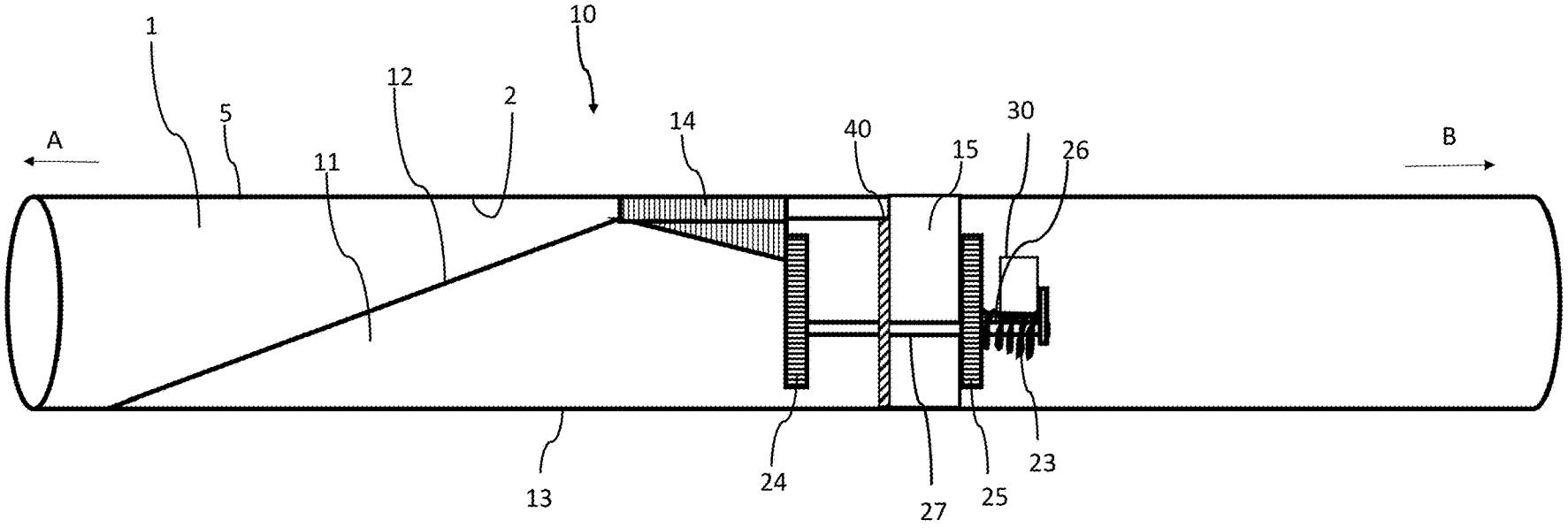

FIGS. 2A-2B shows time-lapse of relative positions of a whipstock assembly 10 according to a second embodiment of the invention where an activation device 20 of the whipstock assembly comprises one mutual pre-tensioned spring 23 arranged below both an anchoring device 14 and a sealing device 15 of the whipstock assembly 10.

In particular, FIG. 2A shows the whipstock assembly 10 in a run state being installed in the well 1 using a drill string 4, and FIG. 2B shows the situation when the anchoring device 14 and the sealing device 15 have entered their respective set states in that the locking device 30 is in a second position in which the locking device 30 allows activation of the activation device 20 thereby forcing the anchoring device 14 to the set state and the sealing device 15 to the set state.

In FIG. 2A, the locking device 30 of the whipstock assembly 10 is in a first position preventing both the anchoring device 14 and the sealing device 15 of the whipstock assembly 10 from moving from their respective run states to set states.

Referring to FIGS. 2A-2B a well 1 cased with a casing 5 is shown. The well 1, i.e. the casing 5, has an inner wall 2. Arrow A indicates the direction towards the top of the well 1, i.e. towards surface, whereas Arrow B indicates the direction towards the bottom of the well 1, i.e. direction away from surface of the well 1.

The whipstock assembly 10 comprises a housing 13 extending along a longitudinal direction of the well 1. In an upper part of the housing 13 it is disclosed a whipstock device 11 with an inclined surface 12 for deflecting a drill bit of a drill string 4. The whipstock device 11 functions as a sliding ramp and has an inclined surface 12 for directing the drill string (i.e. drill bit of the drill string) towards the wall 2 of the well to drill a window (not shown) in the casing 5 and further continue drilling into the surrounding formation. The form, shape, function and construction of the whipstock device 11 is known to the person skilled in the art and will not be discussed in greater detail herein.

Below the whipstock device 11 of the whipstock assembly 10, the anchoring device 14 in the form of a slips segment is disclosed. The anchoring device 14 has a run state and a set state. In the run state, the anchoring device 14 is configured to be run into the well 1, and in the set state the anchoring device 14 is configured to anchor against the inner wall 2 of the well 1 or casing 5.

The sealing device 15 is arranged below the anchoring device 14. The sealing device 15 has a run state and a set state. In the run state, the sealing device 15 is configured to be run into the well 1, and in the set state the sealing device 15 is configured to seal against the inner wall 2 of the well 1.

The activation device 20 for actuating the anchoring device 14 from the run state to the set state and for actuating the sealing device 15 from the run state to the set state, may be similar to the activation device 20 with a locking device 30 described in relation to FIGS. 1A-1D. Alternatively, other activation mechanisms such as a chamber with a break disc that collapse over a pre-determined differential pressure, or an electric system allowing a chamber to collapse when receiving and input signal (such as pressure pulse).

The activation device 20 comprises a locking device 30 which is operable between a first position in which the locking device 30 prevents activation of the activation device 20, and a second position in which the locking device 30 allows activation of the activation device 20 thereby forcing the anchoring device 14 to the set state and the sealing device 15 to the set state.

A stopper element 40 is arranged between the anchoring device 14 and the sealing device 15. The stopper element 40 is configured to prevent axial movement of the sealing device 15 in the well 1 such that it compresses in the radial direction. The relative position of the stopper element 40 and the whipstock device 11 is constant such that once the sealing device 15 is pushed towards the stopper element 40 from below, the sealing device 15 will compress in the radial direction towards the inner wall 2 of the well 1.

The activation device 20 is further disclosed comprising a mutual pre-tensioned spring 23 arranged below the sealing device 15.

The activation device 20 comprises a first piston element 24 in contact with the anchoring device 14 and a second piston element 25 in contact with the scaling device 15. The first piston element 24 is arranged below the anchoring device 14 and the second piston element is arranged below the sealing device 15. A distance element 27 provides a fixed distance between the first piston element 24 and the second piston element 25.

The mutual pre-tensioned spring 23 is arranged below the second piston element 25 and is configured to exert a force on the second piston element 25 via the distance element 27 and to the first piston element 24 thereby forcing both the anchoring device 14 and the sealing device 15 to their respective set states. Thus, the mutual pre-tensioned spring 23 activates both the anchoring device 14 to the set state and the sealing device 15 to the set state.

The distance element 27 provides a fixed distance between the first piston element 24 and the second piston element 25 such that the anchoring device 14 and the sealing device 15 are activated upon releasing the mutual pre-tensioned spring 23. As disclosed in FIGS. 2A and 2B, the distance element 27 extends from a position below the sealing device 15, upwardly through a center of the sealing device 15, and to the anchoring device 14. The distance element 27 is illustrated as a rod and the first piston element 24 and the second piston element 25 are fixedly connected to opposite end regions of the rod. As shown, the first piston element 24 is connected at an upper end of the rod and the second piston element 25 is connected at a lower end of the rod.

The activation device 20 further comprises a connection element 28 arranged between the first piston element 24 and the second piston element 25. The connection element 28 is fixed to the housing 13 and provides an end point for the first pre-tensioned spring 21 and the second pre-tensioned spring 22. The connection element 28 ensures that the first pretensioned spring 21 and the second pre-tensioned spring 22 exerts the stored force against the respective first piston element 24 and second piston element 25. In other words, the connection element 28 is configured to withstand the forces from the first pre-tensioned spring 21 and the second pre-tensioned spring 22.

A guiding means 26 in the form of a rod extending from the distance element 27 guides movement of the mutual pre-tensioned spring 23 in a desired direction upon activation of the anchoring device 14 to the set state and the sealing device 15 to the set state.

In the preceding description, various aspects of the independent claims have been described. For purposes of explanation, specific numbers, systems and configurations were set forth in order to provide a thorough understanding of the system and its workings. However, this description is not intended to be construed in a limiting sense. Various modifications and variations of the illustrative embodiment, as well as other embodiments of the system and method, which are apparent to persons skilled in the art to which the disclosed subject matter pertains, are deemed to lie within the scope of the present invention as defined in the attached claims.

LIST OF REFERENCE NUMBERS

| | |
|---|---|
| 1 | Well |
| 2 | Inner wall of the well/casing |
| 3 | Casing |
| 4 | Drill string |
| 5 | Casing |
| 10 | Whipstock assembly |
| 11 | Whipstock device |
| 12 | Inclined surface |
| 13 | Housing |
| 14 | Anchoring device/slips segment |
| 15 | Sealing device |
| 20 | Activation device |
| 21 | First pre-tensioned spring |
| 22 | Second pre-tensioned spring |
| 23 | Mutual pre-tensioned spring |
| 24 | First piston element |
| 25 | Second piston element |
| 26 | Guiding means |
| 26' | First rod |
| 26" | Second rod |
| 27 | Distance element (27) |
| 28 | Connection element |
| 30 | Locking device |
| 31 | Internal chamber |
| 32 | Fluid connection port |
| 33 | First member |
| 34 | Second member |
| 35 | Cross link |
| 40 | Stopper element |
| A | Towards top of the well |
| B | Towards bottom of well |

The invention claimed is:

1. A whipstock assembly for installation in a well, the whipstock assembly comprising:

a housing extending in a longitudinal direction;

a whipstock device with an inclined surface located in an upper part of the housing for deflecting a drill string;

an anchoring device below the whipstock device, the anchoring device having a run state and a set state, and wherein in the run state the anchoring device is configured to be run into the well and in the set state the anchoring device is configured to anchor against an inner wall of the well;

a sealing device below the whipstock device, the sealing device having a run state and a set state, and wherein in the run state the sealing device is configured to be run into the well and in the set state the sealing device is configured to seal against the inner wall of the well;

an activation device for actuating the anchoring device from the run state to the set state and for actuating the sealing device from the run state to the set state; and a locking device operable between:

a first position in which the locking device prevents activation of the activation device; and a second position in which the locking device allows activation of the activation device thereby forcing the anchoring device to the set state and the sealing device to the set state, wherein the activation device comprises a first piston element in contact with the anchoring device, a second piston element in contact with the sealing device, and one mutual pre-tensioned spring for activating both the anchoring device and the sealing device, wherein the mutual pre-tensioned spring is configured to exert a force on the first piston element to force the anchoring device into the set state and on the second piston element to force the sealing device into the set state, wherein the locking device prevents expansion of the mutual pre-tensioned spring in the first position and allows expansion of the mutual pre-tensioned spring in the second position, and wherein the mutual pre-tensioned spring is arranged between the anchoring device and the sealing device, or below the anchoring device and the sealing device.

2. The whipstock assembly according to claim 1, further comprising a stopper element on an opposite side of the sealing device compared to the activation device, and wherein the stopper element is configured to prevent axial movement of the sealing device in the well.

3. The whipstock assembly according to claim 1, wherein the mutual pre-tensioned spring is arranged between the anchoring device and the sealing device, and wherein the activation device comprises a guiding means for guiding movement of the mutual pre-tensioned spring in a desired direction upon activation of the anchoring device to the set state and the sealing device to the set state.

4. The whipstock assembly according to claim 1, wherein the mutual pre-tensioned spring is arranged between the anchoring device and the sealing device, and wherein the mutual pre-tensioned spring is configured to exert an upward force on the anchoring device to the set state of the anchoring device and to exert a downward force on the sealing device to the set state of the sealing device.

5. The whipstock assembly according to claim 1 wherein the mutual pre-tensioned spring is arranged between the anchoring device and the sealing device, and wherein one end of the mutual pre-tensioned spring is configured to exert a force on the first piston element and a second end of the mutual pre-tensioned spring is configured to exert a force on the second piston element.

6. The whipstock assembly according to claim 1, wherein the activation device comprises a distance element providing a fixed distance between the first piston element and the second piston element, and wherein the second piston element is arranged below the sealing device, and the mutual pre-tensioned spring is arranged below the anchoring device and the sealing device.

7. The whipstock assembly according to claim 1, wherein the housing comprises:

an internal chamber for accommodating the locking device; and a fluid connection port, wherein the fluid connection port extends between an outside of the housing and to the internal chamber, wherein the locking device is radially movable from the first position to the second position within the internal chamber upon exertion of a fluid pressure from the outside of the housing through the fluid connection port and into the internal chamber.

8. The whipstock assembly according to claim 1, wherein the anchoring device comprises a slips segment.

9. A method of installing the whipstock assembly according to claim 1, the method comprising:

connecting the whipstock assembly to the drill string;

ensuring that the locking device is in the first position so as to prevent activation of the activation device;

running the drill string and the connected whipstock assembly to a position in the well where a branch is to be drilled;

disconnecting the whipstock assembly from the drill string; and applying a pressure in the well at the position of the whipstock assembly thereby activating the locking device to the second position so as to allow activation of the activation device thereby forcing the anchoring device to the set state and the sealing device to the set state.

10. The method according to claim 9, wherein the housing comprises an internal chamber for accommodating the locking device and a fluid connection port, wherein the fluid connection port extends between an outside of the housing and to the internal chamber, and wherein the applying of the pressure in the well increases the pressure in the internal chamber thereby moving the locking device in a radial direction to the second position.

* * * * *